United States Patent [19]

Burnham

[11] Patent Number: 4,949,698

[45] Date of Patent: Aug. 21, 1990

[54] BOW RELEASE

[75] Inventor: David Burnham, Memphis, N.Y.

[73] Assignee: Oneida Labs, Inc., Syracuse, N.Y.

[21] Appl. No.: 349,767

[22] Filed: May 10, 1989

[51] Int. Cl.[5] ..... F41B 5/00

[52] U.S. Cl. ..... 124/35.2

[58] Field of Search ..... 124/35 A, 35 R, 25

[56] References Cited

U.S. PATENT DOCUMENTS

| | | | |
|---|---|---|---|
| 4,539,968 | 9/1985 | Garvison | 124/35 A |
| 4,674,469 | 6/1987 | Peck | 124/35 A |
| 4,791,908 | 12/1988 | Pellis | 124/35 A |
| 4,823,761 | 4/1989 | Lewis | 124/35 A |

*Primary Examiner*—Dennis L. Taylor
*Assistant Examiner*—John Ricci
*Attorney, Agent, or Firm*—Wall and Roehrig

[57] ABSTRACT

A bowstring release device for archery has a barrel with a notch at its distal end, and a pivotally mounted bail at the barrel distal end with a cam surface and a finger that projects across the notch to retain the bowstring. A release pin is slidably fitted in the barrel, and has a nose that is biased distally against the bail cam surface. The release pin has front and back cutouts that are axially spaced on the pin. A two part trigger assembly has a back trigger section and a front trigger section that are pivotally mounted on to the barrel, with the back and front sections each having an engaging tooth or sear to fit into a respective one of the release pin recess. The span between the trigger teeth is greater than the span between the two recess. The release is actuated by first pulling back on the trigger, and then gradually relaxing the finger pressure until both of the latch teeth are disengaged from the release pin.

9 Claims, 2 Drawing Sheets

BOW RELEASE

Background of the Invention

This invention relates to archery equipment and is more particularly directed to a device for assisting the archer in drawing and releasing a bowstring.

Various mechanical devices have been proposed to replace human fingers as the means to draw and release a bowstring for shooting arrows, either for target archery or bow hunting. These devices typically have a hand-held barrel with a notch at its distal end to receive the bowstring, and a jaw or latch that catches the bowstring in the notch and holds the same until the archer actuates a triggering mechanism. Several drawing and releasing mechanisms have been proposed which release the bowstring upon squeezing of a trigger lever. Typical release mechanisms appear in U.S. Pat. Nos. 4,485,798; 4,257,386; and 4,169,455. Another device, in which a release lever is held in the fingers and with which the archer shoots by relaxing his hand slightly, is described in U.S. Pat. No. 4,724,821.

There is a desire among archers for a bowstring release device with a more natural feel, i.e., which simulates a finger release by releasing upon relaxation, but which holds the bowstring drawn until the archer decides to let the arrow fly.

Objects and Summary of the Invention

It is an object of this invention to provide a bowstring release device that can be used to assist the archer in drawing the bowstring and holding and releasing the bowstring to obtain optimal accuracy.

It is another object of this invention to provide a bowstring release device that releases the bowstring upon easing of finger pressure on a trigger.

It is a further object of this invention to provide a bowstring release device in which the bowstring is held securely until a trigger is pulled or squeezed, but which does not release the bowstring until finger pressure is subsequently relaxed.

It is a still further object of this invention to provide a bowstring release device that achieves a natural release-on-relax feel akin to that of bare-finger shooting.

According to an aspect of this invention, the bowstring release device has a barrel with a notch as its distal end and a pivotally mounted bail at the distal end of the barrel has a cam surface and a finger that projects across the notch to retain the bowstring. A release pin is slidably fitted in the barrel and has a nose biased distally againt the bail's cam surface. The pin has front and back cutouts spaced axially on the pin, with respective front and back latching surfaces. There is a two-section trigger assembly pivotally mounted on the barrel. A back trigger section has a finger lever formed on it and a latch tooth or sear that projects towards the pin to engage the back latch surface. A front trigger section is pivotally mounted on the back section and has a latch tooth or sear that is directed in towards the pin. The front tooth is slightly longer than the back tooth and the span between the front and back teeth is at least slightly greater than the span between the latching surfaces of the release pin.

With the bowstring in place in the notch, the bail rotates so the bail finger is in front of the bowstring, and the release pin nose blocks the cam surface so the string is held securely. After the bowstring is drawn, the archer primes the device by squeezing or pulling back on the trigger. This lifts the front tooth out of engagement with the release pin and permits the pin to be urged distally until it engages the back tooth. Then, the archer gradually relaxes finger pressure on the trigger finger lever, until the back tooth lifts out of engagement with the pin. This permits the pin to slide axially in the proximal direction and the nose of the pin moves out of blocking engagement with the cam surface of the bail. The bail then rotates until the bail finger releases the bowstring. A small spring on the trigger assembly biases the front section into the barrel, but permits flexure of the two sections so that the back tooth can release as the front tooth slides on an outer surface of the pin.

The above and many other objects, features, and advantages of this invention will be more fully understood from the ensuing detailed description of a preferred embodiment, which should be considered in connection with the accompanying drawing.

DETAILED DESCRIPTION OF THE PREFERRED EMBODIMENT

Figure 1:
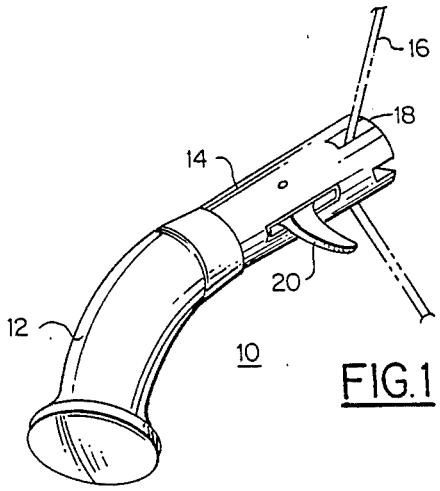
FIG. 1 is a perspective view of a bow string release device according to one embodiment of this invention.
Figure 2:
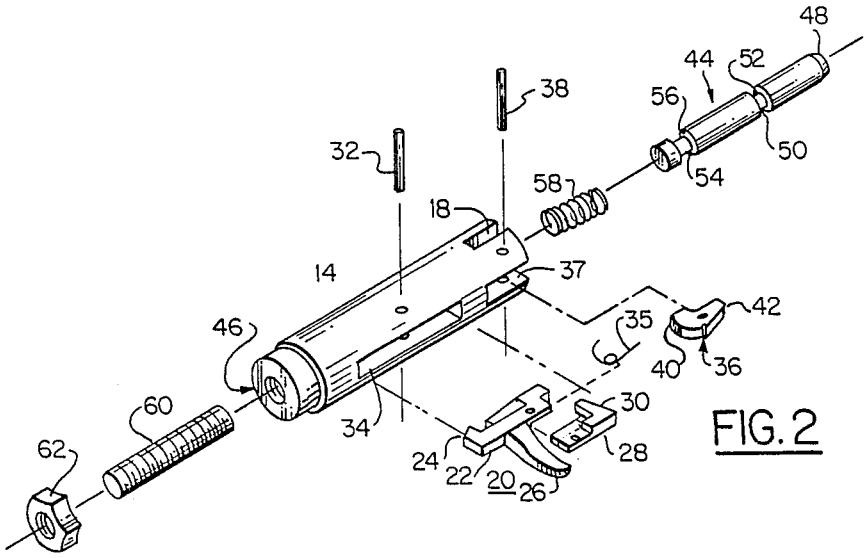
FIG. 2 is an exploded view of the bow string release device of FIG. 1.

With reference to the drawing, and initially to FIGS. 1 and 2, a bow string release device 10 has a handle 12 connected to a housing or barrel 14 of generally cylindrical shape. A bowstring 16 is fitted into a slot 18 at the distal end of the barrel 14. The archer actuates a trigger 20 to release the bowstring 16.

As shown in greater detail in FIG. 2, the trigger 20 has a proximal or back section 22 of which a back latch tooth or sear 24 extends radially into the barrel 14, and a finger lever 26 which extends outward from the barrel. A distal or front section 28 of the trigger 20 has a front latch tooth or sear 30 which is longer than the back tooth 24. The two trigger sections 22 and 28 are rockably connected to the barrel 14 by means of a pivot pin 32. A longitudinal slot 34 in the barrel 14 accommodates the trigger assembly. The trigger front section 28 has at least a small degree of lost motion with respect to the trigger back section 22. The front tooth 30 moves outward when the trigger finger lever 26 is squeezed back, but pivots with respect to the back section 22. This permits the front section 28 and front tooth 30 to remain displaced outwards when the trigger finger lever 26 is released. A small spring 35 can be provided to urge the front trigger section 28 inwards.

Located at the distal end of the barrel 14 is a bowstring retaining bail 36, which is pivotally mounted within a transverse opening 37 on a pivot pin 38. The bail 36 has a cam surface 40 to one side of the pin 38, and a finger 42 extending to the other side of the pin 38 for retaining the bowstring 16 behind it.

A release pin 44 is slidably fitted into a suitable axial bore 46 in the barrel 14. In this case, the release pin 44 is of round cross-section, i.e. generally cylindrical, with a frustoconic nose 48 at its distal end to bear upon the cam surface 40. A front annular latch recess 50 has a tapered latch surface 52, while a back annular latch recess 54 has a latching surface 56 in the form of a shoulder on the pin 44.

Figure 3:
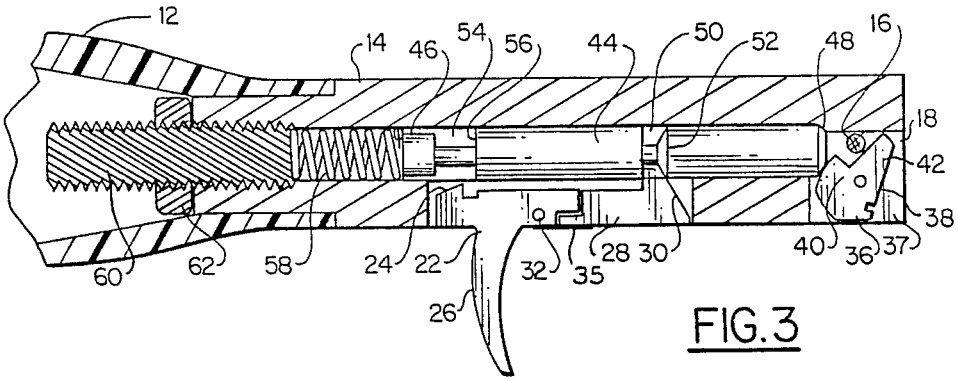
FIGS. 3, 4, and 5 are sectional views for explaining the operation of the device of FIG. 1.

As is clear in FIG. 3, there is a distance or span between the front and back latching surface 52 and 56 that is somewhat smaller than the span between the corresponding latching surfaces of the front tooth 30 and back tooth 24 of the trigger 30. The purpose of this construction will be evident from the discussion to follow.

A compression spring 58 is situated against the proximal end of the release pin 44. A threaded stud 60 is received in a threaded opening in the barrel 14 and bears against this spring. This permits adjustment of the spring force applied to the pin 44. A locking nut 62 is situated on the stud 60.

The operation of this bowstring release is generally as follows, with reference to FIGS. 3, 4, and 5.

Initially, the archer can insert the bow string 16 into the slot 18 to engage the cam finger 42 over the bowstring 16. The release pin 44 maintains the bail 36 in this position by a reason of the nose 48 bearing against the cam surface 40. The release device can be left hanging on the bowstring until the archer is ready to aim and shoot an arrow at a target or game animal.

To employ the release device 10 for firing the bow, the archer holds the device 10 by the handle 12, and draws back the bowstring 16. Then, when the archer is ready to fire the arrow he or she applies sufficient finger pressure to the trigger finger lever 26 to rock the trigger assembly back into the position of FIG. 4. The rocking action lifts the front tooth 30 out of the annular front recess 50, and the release then travels back, or proximally, a slight amount until the back latching surface 56 engages the trigger back tooth 24. At this point, the device 10 is primed for firing.

Figure 5:
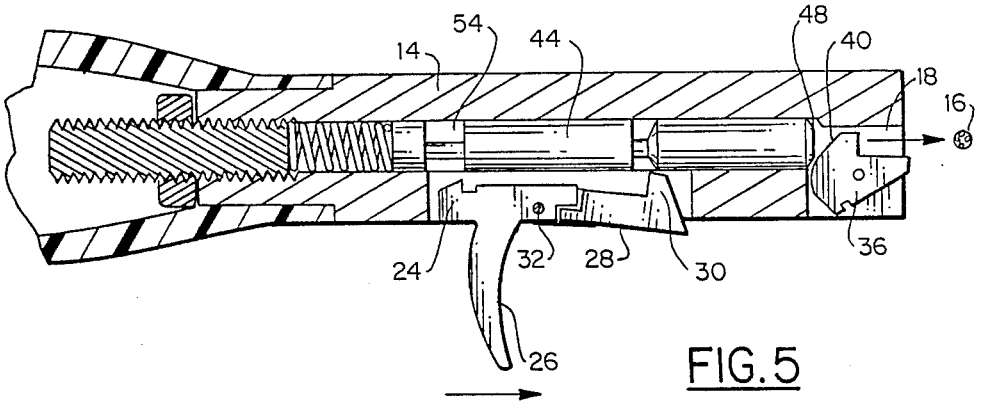

Thereafter, the archer gradually relieves the finger pressure on the finger lever 26, permitting the trigger mechanism to rock back out to the position shown in FIG. 5. Here, the back tooth 24 is lifted out of engagement with the back latch recess 44. Meanwhile, the front section 28 remains pivoted outward so that the tooth 30 is out of engagement with the front latch recess 50. Accordingly, the release pin 44 is free to travel proximally, or rearwards, and the nose 48 permits the cam surface 40 to rotate. The bail 36 continues to rotate, under the pulling force of the bowstring 16, until it reaches the fully opened position shown in FIG. 5. Then the bowstring 16 is released out of the slot 18.

The spring tension of the coil spring 58 can be adjusted by rotating the threaded post 60, to suit the individual archer.

Figure 4:
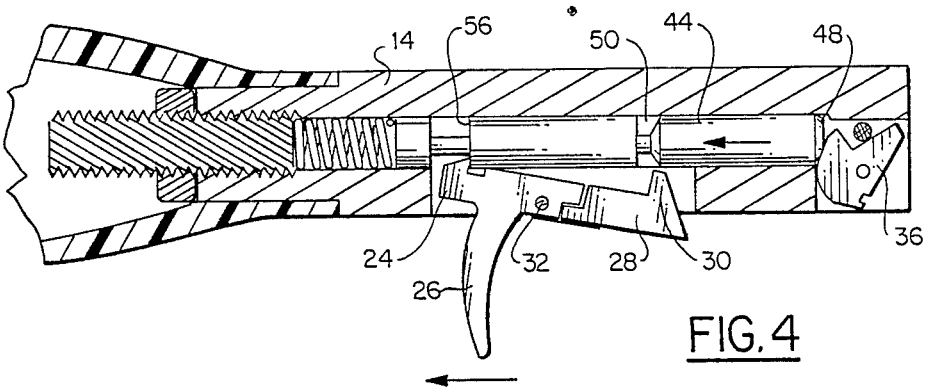

If the archer decides not to fire the arrow after having pulled back the trigger, i.e. to the position shown in FIG. 4, it is necessary only to bring the bowstring back forward to take tension off. Then, with the bowstring 16 no longer urging the bail 36 to rotate, the spring 58 will move the pin 44 forward, and the front trigger tooth 30 will re-engage the recess 50 as soon as the trigger 20 is released.

While the release-on-relax bowstring release device of this invention has been shown in detail with respect to a single preferred embodiment, it should be understood that the invention is not limited to that precise embodiment. Rather, many modifications and variations would present themselves to those of skill in the art without departure from the scope and spirit of this invention, as defined in the appended claims.

What is claimed is:

1. A bowstring release device comprising an elongated housing; a bowstring retaining bail pivotally mounted at one end of said housing and having a bowstring retaining finger and a cam surface; a release pin slidably movable within said housing, having a nose which bears against said cam surface, and front and back latching surfaces spaced axially from one another by a predetermined span along said pin; means resiliently biasing said pin distally; and a trigger assembly rockably mounted on said housing including a finger lever protruding from the housing and front and back latch members spaced axially from one another by a span greater than the predetermined span between the latching surfaces on the pin; such that when the bowstring is drawn, until finger pressure is applied to said trigger assembly finger lever, the front latch bears against the front latching surface so that the nose of the pin presents said bail from pivoting to an open position, when finger pressure is applied to said finger lever with the bowstring drawn, the trigger front latch releases from the front latching surface so that the pin slides proximally by urging of the cam surface to engage the back latch with the back latch surface; and thereafter when finger pressure is relaxed from the finger lever the back latch disengages from the back latch surface permitting the release pin to slide proximally so that the bail can pivot to release the bowstring.

2. A bowstring release device according to claim 1 wherein said pin has front and back recesses on which the front and back latching surfaces are respectively disposed.

3. A bowstring release device according to claim 1 wherein said trigger assembly has a front section on which is formed said front latch and pivotally mounted on a back section on which is formed said back latch.

4. A bowstring release device according to claim 3 wherein said front latch includes a tooth extending a first predetermined distance into the housing for engaging the release pin front latching surface, and said back latch includes a tooth extending a second predetermined distance into the housing for engaging the release pin back latching surface.

5. A bowstring release device according to claim 4 wherein said first predetermined distance is longer than said second predetermined distance.

6. A bowstring release device according to claim 3 wherein said trigger assembly further includes a spring biasing the front section in the sense to urge the front section towards said pin.

7. A bowstring release device according to claim 1 wherein said resilient biasing means includes a coil spring bearing against a proximal end of the pin and a threaded member received in a threaded opening in said housing and on which the coil spring is reposed for adjusting the biasing force of said spring on said pin.

8. A bowstring release device according to claim 1 wherein said pin is of round cross section.

9. A bowstring release device according to claim 8 wherein said nose includes a generally conic surface which bears against the cam surface.

* * * * *